US005355557A

United States Patent [19]

Cress et al.

[11] Patent Number: 5,355,557

[45] Date of Patent: Oct. 18, 1994

[54] CONCEALED SELF-CLOSING HINGE WITH INTEGRAL HINGE PIN MEANS

[75] Inventors: David R. Cress, Janesville, Wis.; Michael J. Bowers, Rockford; A. Raymond King, IV, Machesney Park, both of Ill.

[73] Assignee: Amerock Corporation, Rockford, Ill.

[21] Appl. No.: 63,032

[22] Filed: May 18, 1993

[51] Int. Cl.[5] ..... E05F 1/08

[52] U.S. Cl. ..... 16/286; 16/297; 16/335; 16/296; 16/303

[58] Field of Search ..... 16/286, 284, 289, 292, 16/296, 297, 235, 303, 335, 341, 342, 379, 380

[56] References Cited

U.S. PATENT DOCUMENTS

| | | | |
|---|---|---|---|
| 3,237,239 | 3/1966 | Rudnick | 16/145 |
| 3,908,228 | 9/1975 | Newcomer | 16/286 |
| 4,114,236 | 9/1978 | Vandervort | 16/335 |
| 4,287,641 | 9/1981 | MacDonald | 16/139 |
| 4,509,229 | 4/1985 | Salice | 16/379 |
| 4,654,930 | 4/1987 | Lautenschager et al. | 16/296 |
| 4,716,622 | 1/1988 | DeBruyn | 16/297 |
| 4,800,624 | 1/1989 | Whitefoot et al. | 16/335 |
| 4,819,299 | 4/1989 | Holan | 16/303 |
| 5,027,474 | 7/1991 | Bowers | 16/297 |

*Primary Examiner*—P. Austin Bradley
*Assistant Examiner*—Chuck Y. Mah
*Attorney, Agent, or Firm*—Leydig, Voit & Mayer

[57] ABSTRACT

A concealed self-closing hinge for mounting a door on a frame. The door member of the hinge includes a cup formed with vertically aligned slots. The frame member of the hinge includes an arm whose free end is formed with integral pintles which are pivotally received in the slots. A plastic cam is adapted to be slipped onto the free end portion of the arm between the pintles and coacts with a leaf spring to hold the pintles in assembled relation with the slots and also to effect self-closing of the door.

5 Claims, 3 Drawing Sheets

CONCEALED SELF-CLOSING HINGE WITH INTEGRAL HINGE PIN MEANS

FIELD OF THE INVENTION

The present invention relates in general to a self-closing hinge for mounting a cabinet door for swinging between open and closed positions on a cabinet frame and, more particularly, to a self-closing hinge which is concealed from view from the front of the cabinet.

BACKGROUND OF THE INVENTION

Self-closing hinges customarily include door and frame members mountable on a door and frame, respectively, and interconnected by a hinge pin. Spring means are carried by the door member of the hinge and act against part of the frame member of the hinge. After the door has been swung a predetermined distance from its open position toward its closed position, the spring means cause the door to swing the rest of the way closed and resiliently hold the door in its closed position.

More specifically, the invention relates to a concealed self-closing hinge of the same general type as disclosed in DeBruyn U.S. Pat. No. 4,716,622 and Bowers U.S. Pat. No. 5,027,474. In such hinges, the door member is, for the most part, formed by a cup which is adapted to nest within a pocket formed in the inner side of the door. The hinge pin is supported by the cup and is connected to the frame member of the hinge in such a manner that, when the door is fully closed, virtually all parts of the hinge are concealed from view from the front of the cabinet.

In the hinge of the Bowers patent, the frame member and the hinge pin may be assembled with the door member simply by slipping the hinge pin into slots in the cup of the door member. A leaf spring is used to advantage not only to effect the self-closing action but also to hold the hinge pin in assembled relation with the cup. A plastic cam is supported on the hinge pin and coacts with the leaf spring to effect the self-closing action without producing significant wear between the cam and the spring. The plastic cam is located between two lugs of a clevis which receives the hinge pin.

While the hinge disclosed in the Bowers patent functions admirably and has experienced significant commercial success, it is time-consuming, and thus costly, to manufacture the hinge pin, to insert the plastic cam between the two lugs of the clevis and to insert the hinge pin through holes in the clevis and the cam.

SUMMARY OF THE INVENTION

The general aim of the present invention is to provide a new and improved hinge which requires fewer components and which may be manufactured and assembled in a less expensive manner than prior hinges of the same general type.

A more detailed object of the invention is to achieve the foregoing by providing a hinge in which the hinge pin is formed as an integral component of the frame member of the hinge and in which the cam is adapted to be simply slipped into assembled relation with the frame member/hinge pin unit.

The invention also resides in the provision of unique means for holding the cam in a fixed position with respect to the frame member/hinge pin unit.

These and other objects and advantages of the invention will become more apparent from the following detailed description when taken in conjunction with the accompanying drawings.

DETAILED DESCRIPTION OF THE PREFERRED EMBODIMENTS

Figure 3:
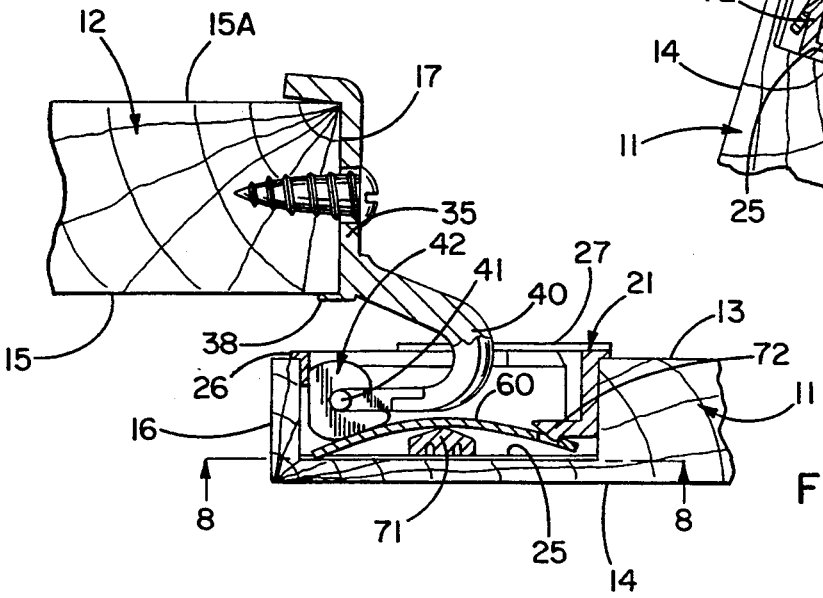
FIG. 3 is a view similar to FIG. 2 but shows the door in a fully closed position.

For purposes of illustration, the hinge 10 of the present invention is shown in the drawings as being used for mounting a substantially solid door 11 made of wood or other non-metallic material for swinging between open and closed positions on the frame 12 of a kitchen cabinet. In this instance, the door is of the overlay type in that, when the door is closed as shown in FIG. 3, the inner and outer face surfaces 13 and 14 of the door overlap the outer face surface 15 of the frame while the hinged edge surface 16 of the door is spaced laterally from the adjacent parallel edge surface 17 of the frame.

Figure 1:
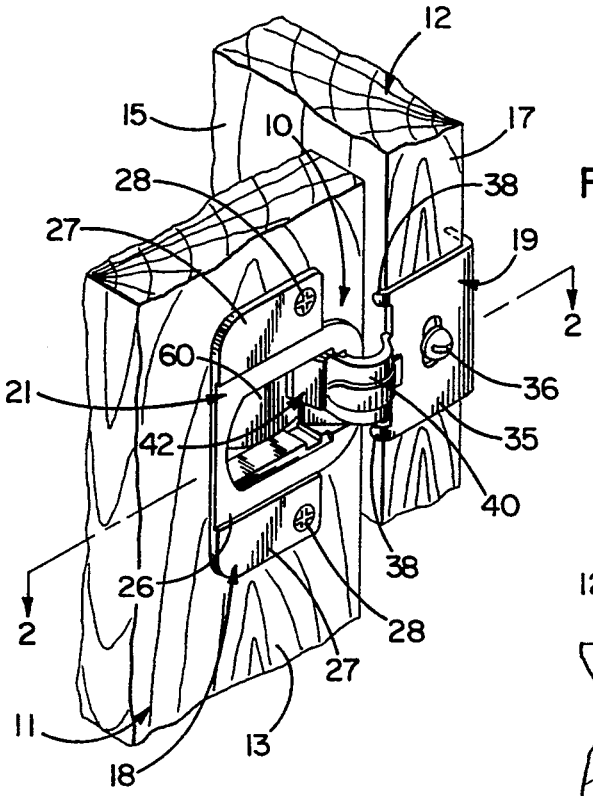
FIG. 1 is a fragmentary perspective view showing a cabinet door swingably mounted on a cabinet frame by one embodiment of a new and improved hinge incorporating the features of the present invention.
Figure 8:
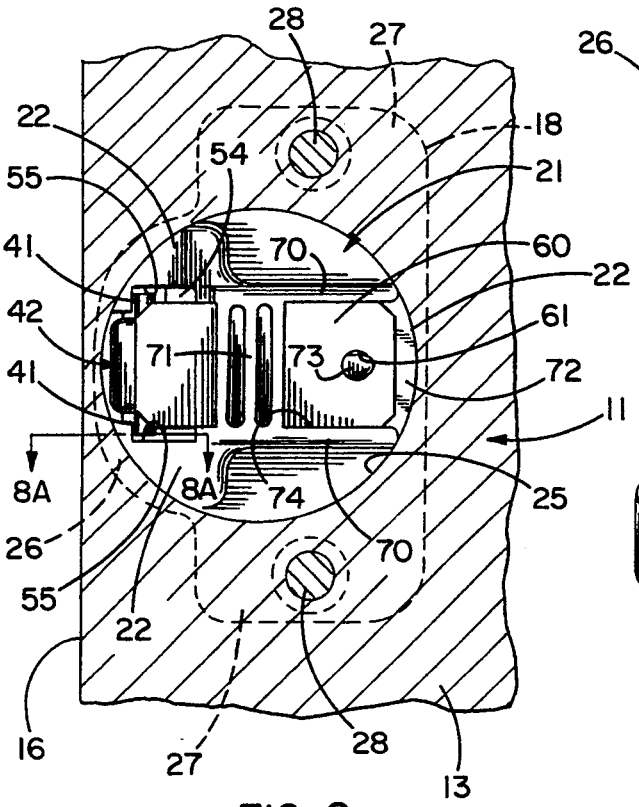
FIG. 8 is a fragmentary cross-section taken substantially along the line 8—8 of FIG. 3.

As shown in FIG. 1, the hinge comprises door and frame members 18 and 19 adapted to be mounted on the door 11 and the frame 12, respectively. The door member 18 is adapted to be mounted within a cylindrical bore or pocket 25 (FIGS. 2, 3 and 8) formed in the inner surface 13 of the door in order to conceal the hinge from view from the front of the cabinet. In the illustrated embodiment, the door member 18 preferably is die cast of metal and comprises a generally box-like cup 21 with a substantially open end adjacent the inner surface 13 of the door. The cup includes arcuate wall sections 22 (FIG. 8) on two sides of the cup to locate the cup within the cylindrical pocket 25 of the door. A flange 26 extends around and transversely from the open end of the cup and lies substantially flush with the inner surface 13 of the door. Two oppositely extending mounting plates 27 (FIG. 1) are formed integrally with the flange 26 and are disposed face-to-face with the inner surface 13 of the door. Screws 28 extend through the mounting plates 27 to fasten the door member 18 of the hinge securely to the door.

Figure 2:
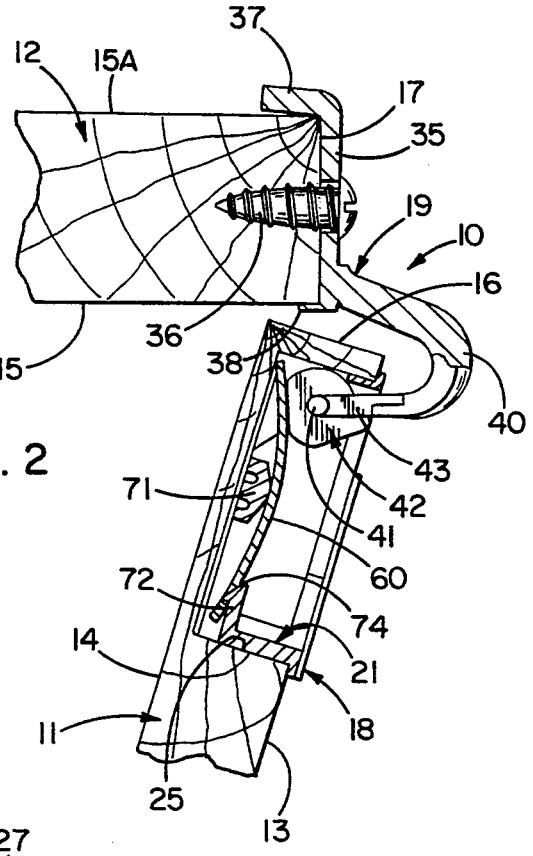
FIG. 2 is an enlarged fragmentary cross-section taken substantially along the line 2—2 of FIG. 1 and shows the door in a fully open position.
Figure 4:
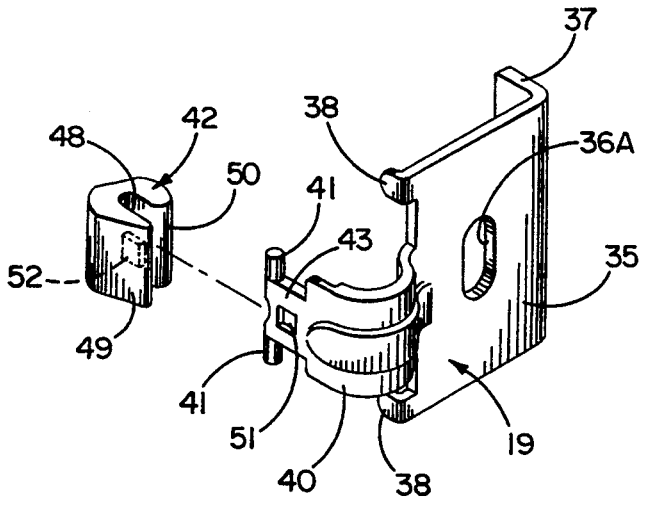
FIG. 4 is an exploded perspective view of the cam and the frame member of the hinge.
Figure 5:
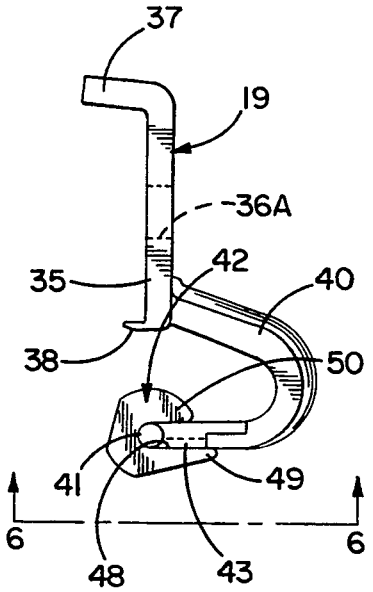
FIG. 5 is a top plan view of the cam and the door member of the hinge.
Figure 6:
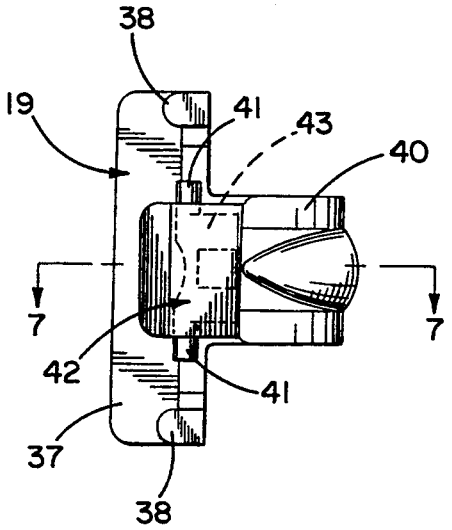
FIG. 6 is an elevational view as seen along the line 6—6 of FIG. 5.

As illustrated in FIGS. 1 and 2, the frame member 19 of the hinge 10 includes a stamped metal mounting wing 35 which lies against the edge surface 17 of the frame 12 and which is fastened to the frame by a screw 36 extending through a vertically elongated slot 36A (FIG. 4) in the wing. A flange 37 is formed integrally with is disposed at right angles to the wing 35 and lies against the inner surface 15A of the frame while two integral and right-angled tabs 38 lie against the outer surface 15 of the frame. An arm 40 is formed integrally with the outer edge of the wing 35 midway between the upper and lower ends thereof. The arm extends laterally and outwardly away from the edge surface 17 of the frame 12 and then curves sharply and extends in a reverse lateral direction toward the edge surface 17 and in outwardly spaced relation with the outer face surface 15 of the frame.

In accordance with the present invention, the cost of manufacturing and assembling the hinge 10 is reduced significantly by forming hinge pin means 41 integrally with the free end portion of the arm 40 and by providing the hinge with a plastic self-closing cam 42 which may be easily slipped into assembled relation with the arm in the vicinity of the hinge pin means. As a result, there is no need to separately manufacture and assemble a hinge pin and, in addition, assembly of the self-closing cam 42 is a relatively fast and simple operation.

In the present instance, the free end portion of the arm 40 is formed by a flat and generally rectangular tongue 43 (FIG. 4) which is integral with the main body of the arm. The hinge pin means 41 are defined by two cylindrical pintles formed integrally with and projecting in vertically opposite directions from the tongue 43. The diameter of each pintle 41 is just slightly less than the thickness of the tongue 43 and thus the pintles do not disrupt the flat side surfaces of the tongue. The pintles are formed by a progressive die which blanks the frame member 29 from sheet metal.

Figure 7:
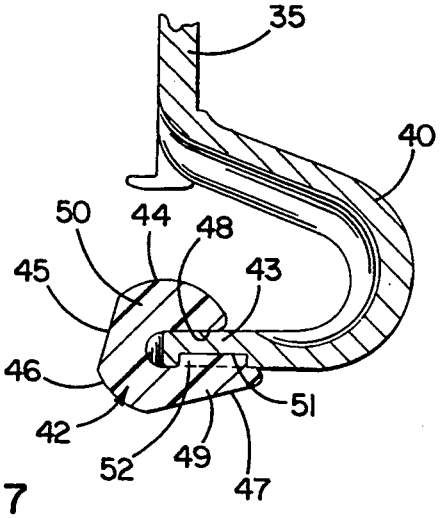
FIG. 7 is an enlarged fragmentary cross-section taken substantially along the line 7—7 of FIG. 6.

The self-closing cam 42 is in the form of a block made of a durable, wear-resistant and somewhat resilient plastic such as "Delrin". Herein, the nose of the cam includes an inner curved surface 44 (FIG. 7), an adjacent flat surface 45, an outer curved surface 46 and an adjacent flat surface 47. In carrying out the invention, a vertically extending slot 48 (FIG. 4) is formed through the cam and terminates short of the nose thereof, the slot 48 causing the cam to be formed with two spaced wings 49 and 50. When the plastic of the cam is in a relaxed condition, the spacing between the wings 49 and 50 is somewhat less than the thickness of the tongue 43.

To assemble the cam 42, the latter is simply slipped toward the arm 40 to cause the tongue 43 to enter the slot 48 and to cause the wings 49 and 50 to frictionally grip the sides of the tongue. To fix the cam in a pre determined position on the tongue, the cam and the tongue are formed with coacting detents. In the embodiment of the hinge shown in FIGS. 1–8, the detents comprise an opening or pocket 51 (FIGS. 4 and 7) formed in one side of the tongue 43 and a projection or boss 52 formed on the inboard face of the wing 49 of the cam. The pocket and the boss are generally rectangular. When the cam 42 is slipped onto the tongue 43, the boss 52 rides along the side of the tongue until it snaps into the pocket 51. Thereafter, the boss and the pocket coact to prevent the cam from being pulled off of the tongue and from shifting vertically on the tongue. In its installed position, the cam is located midway between the pintles and closely adjacent the inner ends thereof.

Figure 8A:
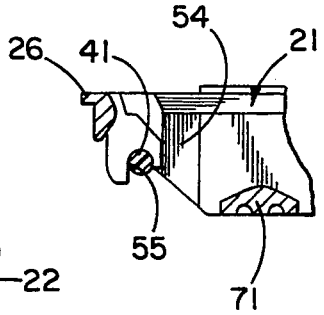
FIG. 8A is a fragmentary cross-section taken substantially along the line 8A—8A of FIG. 8.

To connect the door member 18 of the hinge 10 with the frame member 19, the cup 21 is formed with an open space 54 (FIG. 8) between those wall sections 22 which are located adjacent the edge surface 16 of the door 11. The open space 54 is generally T-shaped and is of sufficient height to enable the pintles 41 and the cam 42 to pass through the cup from the open inner side of the cup to the outer side of the cup. Once the pintles have passed through the cup, they are shifted laterally and then outwardly so as to cause the pintles to be pivotally received in a pair of vertically extending and outwardly opening slots 55 (FIGS. 8 and 8A) which open out of the outer end of the cup 21. During opening and closing of the door 11, the pintles 41 turn within the slots 55.

A leaf spring 60 is supported by the cup 21 adjacent the outer end thereof and bears against the cam 42 to hold the pintles 41 in assembled relation with the slots 55 and also to coact with the cam to effect self-closing of the hinge 10 after the door 11 has been swung part way toward its closed position. The leaf spring is a flat plate made of resiliently yieldable and hard tempered steel and includes a hole 61 (FIG. 8) in one end portion for securing the spring to the cup.

To support the spring 60, the outer end of the cup is defined by two parallel and generally horizontal walls 70 (FIG. 8) extending outwardly at right angles to the flange 26 and the mounting plates 27 and extending between the arcuate sections 22. A bridge 71 is formed integrally with and extends between the walls 70 intermediate the ends thereof and adjacent the outer end of the cup. A flange 72 (FIG. 8) with a locking detent 73 is spaced in one direction from the bridge 71 and also is formed integrally with and extends between the walls 70 adjacent the ends of the walls. As a result of the spaced relation of the flange from the bridge, an opening 74 is formed through the cup between the flange and the bridge.

The spring 60 is positioned such that the end portion of the spring containing the hole 61 rests on the flange 72 outside the cup 21. The hole receives the detent 73 to hold the spring. As shown in FIG. 2, the spring extends into the cup through the opening 74 and is bowed around the inner side of the bridge 71, the inner side of the flange 72 being inclined to facilitate bowing of the spring. The free end portion of the spring bears against the cam 42. As a result of the spring being bowed, the free end portion of the spring is resiliently loaded against the cam and acts through the cam and the tongue 43 to press the pintles 41 into the slots 55. The spring thus retains the pintles in assembled relation with the slots and prevents the pintles from escaping out of the open inner ends of the slots.

When the door 11 is in its fully open position shown in FIG. 2, the free end portion of the spring 60 bears against the flat portion 45 of the cam 42. Due to this pressing on the cam by the spring, there is a resistance opposing free swinging of the door 11 and thus the door tends to remain in the open position. When the door is fully open, the inner face surface 13 is disposed at an angle of about 110 degrees relative to the outer face surface 15 of the frame 12, further opening of the door being prevented by virtue of the inner side of a wall section of the cup 21 engaging the free end section of the arm 40.

As the door 11 is swung from its fully open position toward its closed position, the free end portion of the spring 60 rides around the curved portion 46 of the cam 42 and frictionally restricts free movement of the door until the door reaches an angle of about 25 degrees relative to the frame. At this position, the free end portion of the spring 60 leaves the curved surface 46 of the cam and begins bearing against the flat surface 47 thereof. As the free end portion of the Spring leaves the curved surface 46 of the cam, energy stored in the spring 60 is released and acts through the free end portion of the spring and the curved surface 46 to snap the door to its fully closed position shown in FIG. 3. In the fully closed position of the door, the free end portion of the spring lies in face-to-face relation with the flat surface 47 of the cam and defines a resilient latch for holding the door closed. Before the door may be opened, sufficient force must be exerted on the door to cam and deflect the free end portion of the spring off of the flat surface 47 and into engagement with the curved surface 46. Such deflection loads the spring so that the spring may subsequently effect self-closing of the door as the latter next approaches its closed position.

From the foregoing, it will be apparent that the hinge 10 of the present invention improves on the hinge disclosed in Bowers U.S. Pat. No. 5,027,474 in that the pintles 41 are formed integrally with the arm 40 thus avoiding the need of separately manufacturing a hinge pin and assembling the same with the arm. Moreover, the slip-on nature of the cam 42 simplifies assembly of that component. Accordingly, the present hinge may be manufactured at a lower cost than that of the Bowers patent.

Figure 9:
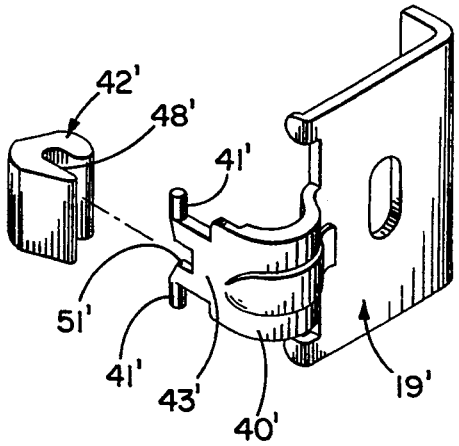
FIGS. 9 and 10 are views similar to FIGS. 4 and 6, respectively, but show a modified embodiment.
Figure 10:
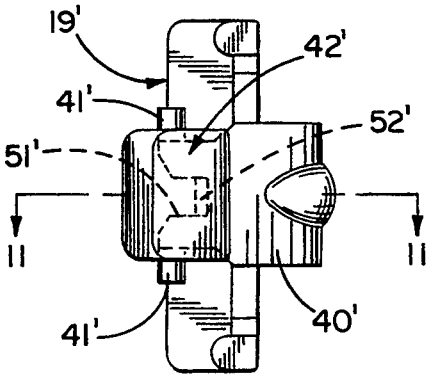
Figure 11:
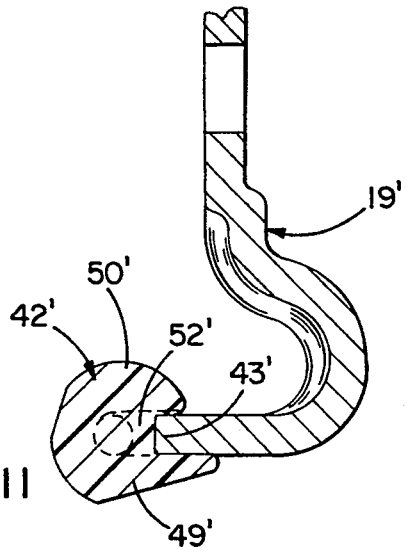
FIG. 11 is an enlarged fragmentary cross-section taken substantially along the line 11—11 of FIG. 10.

FIGS. 9–11 disclose a modified frame member 19' with different detents for captivating the cam 42' on the tongue 43'. In this instance, the tongue is formed with a detent opening in the form of a rectangular notch 51' (FIG. 9) which opens out of both ends of the tongue and out of the free end thereof. The cam 42' is formed with a detent or projection which herein is in the form of a web 52' (FIG. 11) molded integrally with and extending between the wings 49' and 50' of the cam midway between the upper and lower ends of the slot 48'. When the cam 42' is slipped onto the tongue 43' the web 52' moves into the notch 51' with a tight fit. The web and the notch coact to prevent vertical shifting of the cam and also restrict the cam from being pulled off of the tongue.

We claim:

1. A concealed self-closing hinge for mounting a door for swinging on a fixed frame, said hinge comprising a door member having a cup mountable in the door, the cup having a pair of opposing slots with an open space therebetween, said hinge further comprising a frame member having a wing for mounting the frame member on the frame, an arm joined to said wing and having a free end portion extending into said open space, pintles formed integrally with and projecting in opposite direction s from the free end portion of said arm and received pivotally in said slots, a plastic cam having a generally U-shaped slot therein tightly receiving the free end portion of said arm with said pintles projecting in opposite directions from said cam, said cam and the free end portion of said arm being formed with detents which coact to hold said cam releasably on the free end portion of said arm, said detents comprising an opening formed in the free end portion of said arm and further comprising a projection molded integrally with said cam within the U-shaped slot thereof and extending into said opening, and a leaf spring attached to said cup and bearing against said one to press said pintles into seating engagement with said slots, said spring coacting with said cam to bias said door member to a closed position with respect to said frame member after said door member has been swung a predetermined distance toward said closed position about the axes of said pintles.

2. A concealed self-closing hinge as defined in claim 1 in which said opening is a pocket formed in one side of the free end portion of said arm and located short of the free end of said arm, said projection comprising a boss projecting from one of the side walls of the U-shaped slot in said cam and seated snugly in said pocket.

3. A concealed self-closing hinge as defined in claim 1 in which said opening is a notch which opens out of the sides and out of the free end of the free end portion of said arm, said projection comprising a web spanning the side walls of said U-shaped slot between the ends thereof and seated in said notch.

4. A concealed self-closing hinge for mounting a door for swinging on a fixed frame, said hinge comprising a door member having a plate for mounting the door member on said door, a cup formed integrally with and extending from said plate and having an open end located adjacent said plate and an opposite second end, said cup being defined in part by two generally parallel walls extending at right angles to said plate and each having first and second ends, a bridge formed integrally with and extending between the walls intermediate the ends thereof and adjacent the second end of said cup, a circular flange formed integrally with and extending between the walls at the first ends thereof and spaced from said bridge whereby an opening is defined between said flange and said bridge, opposing slots formed in said cup adjacent the second ends of said walls and opening out of the second end of said cup, there being an open space in the second end of said cup between said slots, said hinge further comprising a frame member having a wing for mounting said frame member on said frame, an arm formed integrally with said wing and having a free end portion extending into said cup from the open end thereof and extending into said open space, pintles formed integrally with and projecting in opposite directions from the free end portion of said arm and received pivotally in said slots, a plastic cam having a generally U-shaped slot therein receiving the free end portion of said arm with said pintles extending in opposite directions from said cam, said U-shaped slot having opposing side walls, said pintles defining a pivot axis which extends through said slot between said side walls, and said cam also being located in said open space, and a spring for urging said door member to and releasably holding said door member in a closed position with respect to the frame member, said spring comprising a generally flat plate of resiliently yieldable material, said spring having a first end portion bearing against said flange outside of the interior of said cup, having an intermediate portion extending into said interior of said cup through said opening and bowed around said bridge, and having a second end portion bearing against said cam, said second end portion of said spring exerting a biasing force on said cam and retaining said pintles in said slots.

5. A concealed self-closing hinge for mounting a door for swinging on a fixed frame, said hinge comprising a door member having a cup mountable in the door, the cup having a pair of opposing slots with an open space therebetween, said hinge further comprising a frame member having a wing for mounting the frame member on the frame, an arm joined to said wing and having a free end portion extending into said open space, pintles formed integrally with and projecting in opposite directions from the free end portion of said arm and received pivotally in said slots, a plastic cam having a generally U-shaped slot therein tightly receiving the free end portion of said arm with said pintles projecting in opposite directions from said cam, said U-shaped slot having opposing side walls, said pintles defining a pivot axis which extends through said slot between said side walls, and a leaf spring attached to said cup and bearing against said cam to press said pintles into seating engagement with said slots, said spring coacting with said cam to bias said door member to a closed position with respect to said frame member after said door member has been swung a predetermined distance toward said closed position about the axes of said pintles.

* * * * *